US008922475B2

(12) United States Patent
Yamada

(10) Patent No.: US 8,922,475 B2
(45) **Date of Patent: *Dec. 30, 2014**

(54) CONTROL DEVICE, DISPLAY DEVICE, AND METHOD OF CONTROLLING DISPLAY DEVICE

(75) Inventor: Yusuke Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 604 days.

This patent is subject to a terminal disclaimer.

(21) Appl. No.: 13/212,021

(22) Filed: Aug. 17, 2011

(65) Prior Publication Data

US 2012/0044276 A1 Feb. 23, 2012

(30) Foreign Application Priority Data

Aug. 18, 2010 (JP) ..... 2010-183337

(51) Int. Cl.
*G09G 3/34* (2006.01)
*G09G 5/10* (2006.01)

(52) U.S. Cl.
CPC ..... *G09G 3/344* (2013.01); *G09G 2300/08* (2013.01); *G09G 2310/04* (2013.01); *G09G 2320/103* (2013.01)
USPC ..... 345/107; 345/690

(58) Field of Classification Search
CPC ..... G09G 3/344–3/3453; G09G 3/3685–3/38; G09G 2320/103; G09G 2310/04; G02F 1/167
USPC ..... 345/87–104, 204–215, 690–699, 107
See application file for complete search history.

(56) References Cited

U.S. PATENT DOCUMENTS

| | | | | |
|---|---|---|---|---|
| 4,670,772 | A | 6/1987 | Bolger | |
| 2002/0110351 | A1 | 8/2002 | Champion et al. | |
| 2003/0090486 | A1 | 5/2003 | Ashburn et al. | |
| 2005/0179679 | A1 | 8/2005 | Hosaka et al. | |
| 2006/0097982 | A1 | 5/2006 | Arai et al. | |
| 2007/0205978 | A1 * | 9/2007 | Zhou et al. | 345/107 |
| 2007/0296690 | A1 | 12/2007 | Nagasaki | |
| 2009/0040201 | A1 * | 2/2009 | Kim et al. | 345/204 |

(Continued)

FOREIGN PATENT DOCUMENTS

| | | | |
|---|---|---|---|
| CN | 101542385 | A | 9/2009 |
| JP | 2009-251615 | A | 10/2009 |
| WO | 2008-153211 | A | 12/2008 |

OTHER PUBLICATIONS

European Search Report dated Apr. 20, 2012 in application No. 11165511.4.

*Primary Examiner* — Patrick F Marinelli
(74) *Attorney, Agent, or Firm* — Maschoff Brennan

(57) ABSTRACT

A control device for a display device includes a writing control unit that, in a case where a new writing instruction is generated for one pixel, and a writing operation for the one pixel is determined not to be in the middle of the process, stores write information in each of first storage areas corresponding to the number of times of applying a driving voltage when the display state of the pixel is changed from the first display state to the second display state, sequentially refers to the first storage areas, and applies the driving voltage to the one pixel a plurality of times based on the write information and, in a case where the writing operation is determined to be in the middle of the process for the pixel, continues to perform the writing operation and performs the writing control after the writing operation is completed.

11 Claims, 10 Drawing Sheets

(56) References Cited

U.S. PATENT DOCUMENTS

| | | | | |
|---|---|---|---|---|
| 2009/0046114 | A1* | 2/2009 | Lee et al. | 345/691 |
| 2009/0256798 | A1 | 10/2009 | Low et al. | |
| 2009/0257698 | A1* | 10/2009 | Aritake et al. | 384/484 |
| 2009/0262123 | A1 | 10/2009 | Yoshitake et al. | |
| 2010/0060623 | A1 | 3/2010 | Van Delden et al. | |
| 2011/0001748 | A1* | 1/2011 | Rutman et al. | 345/214 |
| 2011/0279432 | A1* | 11/2011 | Yamada | 345/211 |
| 2012/0062547 | A1* | 3/2012 | Yamada | 345/214 |

* cited by examiner

CONTROL DEVICE, DISPLAY DEVICE, AND METHOD OF CONTROLLING DISPLAY DEVICE

BACKGROUND

1. Technical Field

The present invention relates to a control device, a display device, and a method of controlling a display device.

2. Related Art

An electrophoretic display device is configured by sealing an electrophoretic dispersion liquid that contains one or more types of electrophoretic particles and an electrophoretic dispersion medium between opposing electrode plates, at least one of which is transparent, forming one set. By applying a voltage between two electrodes, the electrophoretic particles move inside the electrophoretic dispersion medium so as to change the distribution thereof. Accordingly, the optical reflection characteristics thereof change, thereby information can be displayed. At this time, in a case where one of the electrodes is configured by a plurality of pixel electrodes separated from one another, by controlling the electric potential of each pixel electrode, the distribution of the particles can be formed so as to be different for each pixel, whereby an image can be formed.

Since it takes a relatively long time to change the display state of an electrophoretic display device, in order to rewrite the display of an active-matrix-type electrophoretic display device, a technology of performing a rewriting operation by using a plurality of frames is known. Here, when a writing operation is started once for the entire screen, as in a liquid crystal display device, for rewriting the display of an electrophoretic display device, a new writing operation cannot be started for several frames. Accordingly, the sensed response speed is low. As a method of solving such a problem, as disclosed in JP-A-2009-251615 or the like, a method is known in which a writing operation is performed by performing a pipeline process in units of a partial area. According to this method, in a case where an image is continuously written into two partial areas of the screen, which do not overlap each other, even when a writing operation for one partial area, which was started first, has not been completed, a writing operation for the other partial area, which is started later, can be started. Therefore, the display speed is improved.

However, according to the method disclosed in JP-A-2009-251615, in a case where partial areas overlap each other in part, the driving of a partial area for which a writing operation is started later needs to wait until a writing operation for another partial area, which was started first, is completed. Accordingly, the display speed is lowered. Although a method may be used in which the partial areas are controlled by software so as not to overlap each other, in such a case, the development of the software is highly complicated.

SUMMARY

An advantage of some aspects of the invention is that it improves the sensed response speed of an electrophoretic display device.

An aspect of the invention is directed to a control device for a display device in which a display unit including a plurality of scanning lines, a plurality of data lines, and a plurality of pixels are included, and writing for changing a display state of each of the pixels from a first display state to a second display state is performed by an operation of applying a driving voltage to the each of the pixels a plurality of times. The control device includes: a rewriting determining unit that determines whether or not a new writing instruction is generated for one pixel out of the plurality of the pixels; a writing state determining unit that determines whether or not a writing operation is in the middle of the process for the one pixel in a case where the new writing instruction is determined to be generated; and a writing control unit that, in a case where the writing operation for the one pixel is determined not to be in the middle of the process by the writing state determining unit, stores write information used for identifying that the one pixel is a target for applying a driving voltage in each of first storage areas corresponding to the number of times of applying a driving voltage when the display state of the pixel is changed from the first display state to the second display state, sequentially refers to the first storage areas, and applies the driving voltage to the one pixel a plurality of times based on the write information that is stored in the first storage areas and, in a case where the writing operation is determined to be in the middle of the process for the one pixel by the writing state determining unit, continues to perform the writing operation that is in the middle of the process and performs the writing control after the writing operation is completed.

According to the above-described control device, it is determined whether a writing operation is in the middle of the process in units of pixels, and a new writing operation can be started as needed from a pixel for which writing has been completed. Therefore, even in the case of a display device in which it takes a relatively long time for rewriting an image, the response speed of an image display can be improved.

In addition, the writing state determining unit may be configured so as to determine that the writing operation is in the middle of the process for the one pixel in a case where the write information used for identifying that the one pixel is a target for applying a driving voltage is stored in the first storage area referred to.

In such a case, it is possible to easily determine whether or not a writing operation is in the middle of the process.

In addition, the above-described control device further includes: a display image data updating unit that stores pixel data of a display image displayed on the display unit in a second storage area based on display image data that is input; and a provisional image data updating unit that stores pixel data of a provisional image to be displayed on the display unit by the writing operation that is in the middle of the process in a third storage area, wherein the provisional image data updating unit updates pixel data of the one pixel with pixel data corresponding to the pixel data of the provisional image of a case where the driving voltage is applied based on all the write information stored in the first storage areas at a timing when writing, which is based on the new writing instruction, is started for the one pixel, and wherein the rewriting determining unit determines that the new writing instruction is generated for the one pixel in a case where the pixel data of the display image that is stored in the second storage area and the pixel data of the provisional image that is stored in the third storage area are different from each other.

In such a case, whether or not new writing is necessary can be readily determined. In addition, no pixel for which new writing is necessary is detected as long as the display image data and the provisional image data coincide with each other, whereby an unnecessary writing operation can be excluded.

In addition, the above-described control device may further include an additional write information calculating unit that, in a case where the pixel data of the display image that is stored in the second storage area and the pixel data of the provisional image that is stored in the third storage area are different from each other, calculates pixel data of an additional writing image that is a difference between the pixel data of the display image and the pixel data of the provisional image by performing a logic operation for the pixel data of the display image and the pixel data of the provisional image and stores the pixel data of the additional writing image in a fourth storage area, wherein the writing control unit updates the write information that is stored in the first storage areas based on the pixel data of the additional writing image that is stored in the fourth storage area.

In such a case, the pixel data to be written can be calculated in a simple process based on the display image data.

In addition, the above-described write information that is stored in the first storage areas may be configured so as to include: first write information that indicates writing for changing the display state of the one pixel from a state representing a first color to a state representing a second color; and second write information that indicates writing for changing the display state of the one pixel from the state representing the second color to the state representing the first color.

In such a case, the write information can be acquired through a simple process.

Another aspect of the invention is directed to a display device in which a display unit including a plurality of scanning lines, a plurality of data lines, and a plurality of pixels are included, and writing for changing a display state of each of the pixels from a first display state to a second display state is performed by an operation of applying a driving voltage to the each of the pixels a plurality of times. The display device includes: a rewriting determining unit that determines whether or not a new writing instruction is generated for one pixel out of the plurality of the pixels; a writing state determining unit that determines whether or not a writing operation is in the middle of the process for the one pixel in a case where the new writing instruction is determined to be generated; and a writing control unit that, in a case where the writing operation for the one pixel is determined not to be in the middle of the process in the determining of whether or not the writing operation is in the middle of the process, performs writing control of storing write information used for identifying that the one pixel is a target for applying a driving voltage in each of first storage areas corresponding to the number of times of applying a driving voltage when the display state of the pixel is changed from the first display state to the second display state, sequentially referring to the first storage areas, and applying the driving voltage to the one pixel a plurality of times based on the write information that is stored in the first storage areas and, in a case where the writing operation is determined to be in the middle of the process for the one pixel in the determining of whether or not the writing operation is in the middle of the process, continues to perform the writing operation that is in the middle of the process and performs the writing control after the writing operation is completed.

According to the above-described display device, it is determined whether a writing operation is in the middle of the process in units of pixels, and a new writing operation can be started as needed from a pixel for which writing has been completed. Therefore, even in the case of a display device in which it takes a relatively long time for rewriting an image, the response speed of an image display can be improved.

The above-described writing state determining unit may be configured so as to determine that the writing operation is in the middle of the process for the one pixel in a case where the write information used for identifying that the one pixel is a target for applying a driving voltage is stored in the first storage area referred to.

In such a case, it is possible to easily determine whether or not a writing operation is in the middle of the process.

In addition, the display device may further include: a display image data updating unit that stores pixel data of a display image displayed on the display unit in a second storage area based on display image data that is input; and a provisional image data updating unit that stores pixel data of a provisional image to be displayed on the display unit by the writing operation that is in the middle of the process in a third storage area, wherein the provisional image data updating unit updates pixel data of the one pixel with pixel data corresponding to the pixel data of the provisional image of a case where the driving voltage is applied based on all the write information stored in the first storage areas at a timing when writing, which is based on the new writing instruction, is started for the one pixel, and wherein the rewriting determining unit determines that the new writing instruction is generated for the one pixel in a case where the pixel data of the display image that is stored in the second storage area and the pixel data of the provisional image that is stored in the third storage area are different from each other.

In such a case, whether or not new writing is necessary can be readily determined. In addition, no pixel for which new writing is necessary is detected as long as the display image data and the provisional image data coincide with each other, whereby an unnecessary writing operation can be excluded.

In addition, the above-described display device may further include an additional write information calculating unit that, in a case where the pixel data of the display image that is stored in the second storage area and the pixel data of the provisional image that is stored in the third storage area are different from each other, calculates pixel data of an additional writing image that is a difference between the pixel data of the display image and the pixel data of the provisional image by performing a logic operation for the pixel data of the display image and the pixel data of the provisional image and stores the pixel data of the additional writing image in a fourth storage area, wherein the writing control unit updates the write information that is stored in the first storage areas based on the pixel data of the additional writing image that is stored in the fourth storage area.

In such a case, the pixel data to be written can be calculated in a simple process based on the display image data.

In addition, the above-described write information that is stored in the first storage areas may be configured so as to include: first write information that indicates writing for changing the display state of the one pixel from a state representing a first color to a state representing a second color; and second write information that indicates writing for changing the display state of the one pixel from the state representing the second color to the state representing the first color.

In such a case, the write information can be acquired through a simple process.

In addition, the above-described display unit may include a display element of a memory type. The display element, for example, is an electrophoretic element.

Still another aspect of the invention is directed to a method of controlling a display device in which a display unit including a plurality of scanning lines, a plurality of data lines, and a plurality of pixels are included, and writing for changing a display state of each of the pixels from a first display state to a second display state is performed by an operation of applying a driving voltage to the each of the pixels a plurality of times. The method includes: determining whether or not a new writing instruction is generated for one pixel out of the plurality of the pixels; determining whether or not a writing operation is in the middle of the process for the one pixel in a case where the new writing instruction is determined to be generated; and performing writing control of storing write information used for identifying that the one pixel is a target for applying a driving voltage in each of first storage areas corresponding to the number of times of applying a driving voltage when the display state of the pixel is changed from the first display state to the second display state, sequentially referring to the first storage areas, and applying the driving voltage to the one pixel a plurality of times based on the write information that is stored in the first storage areas in a case where the writing operation for the one pixel is determined not to be in the middle of the process in the determining of whether or not the writing operation is in the middle of the process, and continuing to perform the writing operation that is in the middle of the process and performing the writing control after the writing operation is completed in a case where the writing operation is determined to be in the middle of the process for the one pixel in the determining of whether or not the writing operation is in the middle of the process.

According to the above-described method, it is determined whether a writing operation is in the middle of the process in units of pixels, and a new writing operation can be started as needed from a pixel for which writing has been completed. Therefore, even in the case of a display device in which it takes a relatively long time for rewriting an image, the response speed of an image display can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described.

Figure 1:
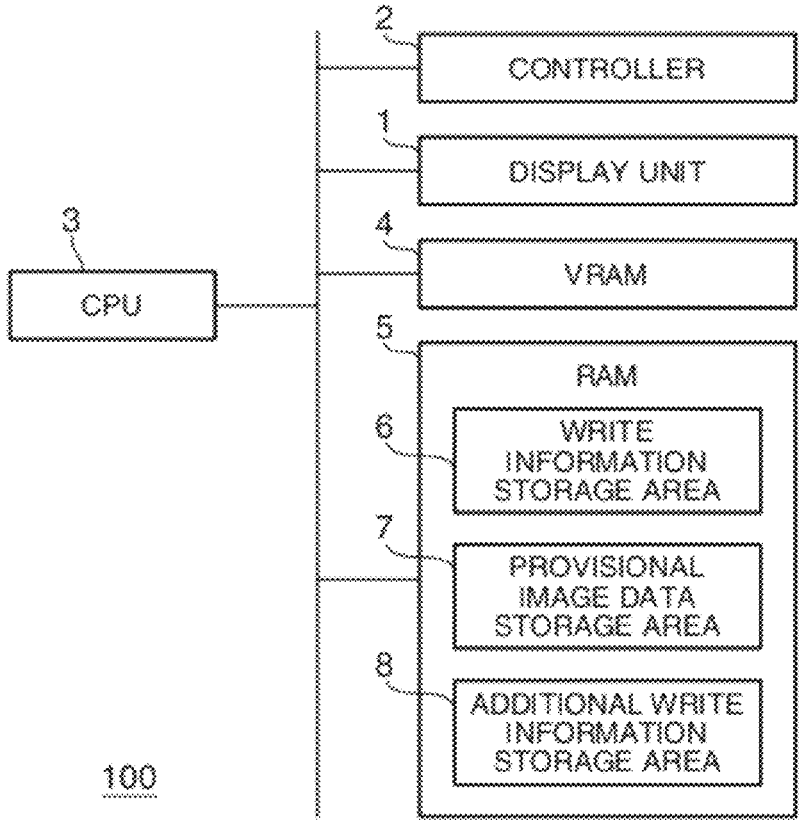
FIG. 1 is a block diagram showing the configuration of an electrophoretic display device according to an embodiment of the invention.

FIG. 1 is a block diagram showing the configuration of an electrophoretic display device (display device) 100 according to this embodiment.

As shown in FIG. 1, the electrophoretic display device 100 includes a display unit 1, a controller (control device) 2, a CPU (Central Processing Unit) (display image data updating unit) 3, a VRAM (Video RAM) (second storage area) 4, and a RAM (Random Access Memory) (a first storage area, a third storage area, and a fourth storage area) 5.

The display unit 1 includes a display element of a memory type and is a display device of which the display state is maintained even in a case where a writing operation is not performed. In this embodiment, the display unit 1 is an electrophoretic-type image display device that has an electrophoretic element as the display element of a memory type and includes a plurality of scanning lines, a plurality of data lines, and a plurality of pixels. In a case where the display state of each pixel is changed, for example, from black (first display state) to white (second display state), an operation of applying a driving voltage to each pixel is necessarily performed a plurality of times (in this embodiment, four times). Similarly, in a case where the display state is changed from white (first display state) to black (second display state), an operation of applying a driving voltage to each pixel is necessarily performed a plurality of times (in this embodiment, four times). The controller 2 controls the display unit 1 by outputting an image signal representing an image to be displayed on the display unit 1 or other various output signals (a clock signal and the like). The CPU 3 is a processor that controls the operation of the electrophoretic display device 100 and particularly stores image data displayed on the display unit 1 in the VRAM 4. The VRAM (second storage area) 4 is a frame buffer and stores image data displayed on the display unit 1 under the control of the CPU 3. Here, the image data means data that represents an image configured by a set of all the pixels of the display unit 1. Also in each storage area to be described later, for convenience of the description, not data corresponding to one pixel but data corresponding to a set of all the pixels will be referred to as image data.

The RAM 5 includes a write information storage area (first storage area) 6, a provisional image data storage area (third storage area) 7, and an additional write information storage area (fourth storage area) 8. The write information storage areas 6 corresponding to the number of times of applying a driving voltage that is necessary for changing the display state of each pixel are prepared and store the contents of a writing operation performed based on the image data stored in the VRAM 4. The controller 2 sequentially refers the write information storage areas 6 and applies driving voltages to the pixels of the display unit 1 based on the contents stored in the write information storage areas 6 that have been referred to. In the provisional image data storage area 7, image data (referred to as provisional image data) is stored which is displayed on the display unit 1 when a writing operation performed for each pixel based on the content stored in the write information storage area 6 is completed. In the additional write information storage area 8, image data that is calculated by the controller 2 based on a difference between the image data stored in VRAM 4 and the image data stored in the provisional image data storage area 7 and is additionally written after the calculation of the difference is stored. In the description presented hereinafter, data stored in each storage area for each pixel or each storage area corresponding to the pixel is referred to as pixel data.

The configuration of the display unit 1 will be described in detail with reference to FIGS. 2 to 4.

Figure 2:
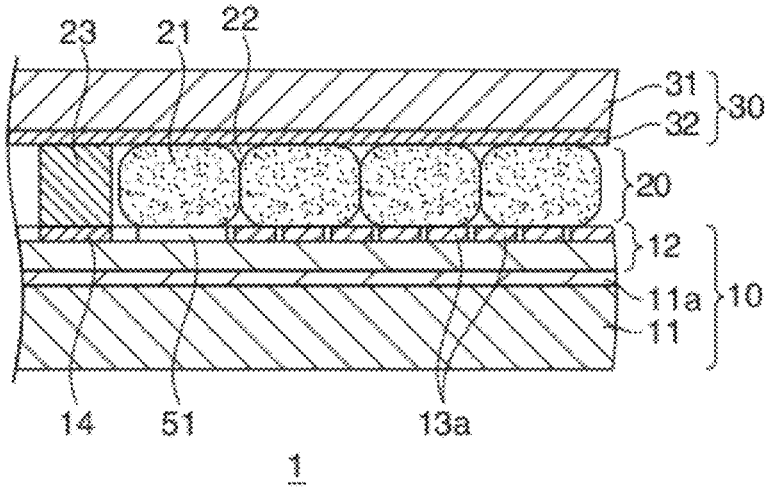
FIG. 2 is a diagram showing the cross-section of a display unit.

FIG. 2 is a diagram showing the cross-section of the display unit 1. As shown in the figure, roughly, the display unit 1 is configured by a first substrate 10, an electrophoretic layer 20, and a second substrate 30. The first substrate 10 is acquired by forming a thin-film semiconductor circuit layer 12 on a flexible substrate 11 as an insulating base substrate that forms an electric circuit. The flexible substrate 11, for example, is a polycarbonate substrate. The thin-film semiconductor circuit layer 12 is stacked on the flexible substrate 11 through an adhesive layer 11*a*. As the material of the flexible substrate 11, a resin material that has superior lightness, flexibility, elasticity, and the like can be used. Here, instead of the flexible substrate 11, a glass substrate or the like that does not have flexibility may be used. In such a case, the thin-film semiconductor circuit layer 12 is formed directly on the substrate without interposing the adhesive layer therebetween.

The thin-film semiconductor circuit layer 12 is configured so as to include a group of wirings that are sequentially arranged in a row direction and a column direction, a group of pixel electrodes, pixel driving circuits, a connection terminal, a row decoder 51 and a column decoder (not shown) that select a pixel to be driven, and the like. The pixel driving circuit is configured so as to include a circuit element such as a thin film transistor (TFT: Thin Film Transistor). The group of pixel electrodes includes a plurality of the pixel electrodes 13*a* that are arranged in a matrix pattern and forms an image display region. In the thin-film semiconductor circuit layer 12, an active matrix circuit that can apply an individual driving voltage to each pixel electrode 13*a* is formed. The connection electrode 14 is used for electrically connecting a transparent electrode layer 32 of the second substrate 30 and a circuit wiring of the first substrate 10 and is formed on the outer periphery portion of the thin-film semiconductor circuit layer 12.

The electrophoretic layer 20 is formed over the pixel electrodes 13*a* and the outer periphery area thereof. The electrophoretic layer 20 is configured so as to include a plurality of microcapsules 21 that are fixed by a binder 22. Inside each microcapsule 21, an electrophoretic dispersion medium and electrophoretic particles are included. In addition, an adhesive layer may be further disposed between the microcapsules 21 that are fixed by the binder 22 and the pixel electrodes 13*a*. The electrophoretic particles have a characteristic such that they move in the electrophoretic dispersion medium in accordance with an applied voltage. As the electrophoretic particles, one or more (here, two) types of electrophoretic particles are used. The electrophoretic layer 20 can be formed by mixing the microcapsules 21 with a desired permittivity regulator in the binder 22 and coating the upper face of a base formed from the acquired resin composition by using a known coating method.

Here, as the electrophoretic dispersion medium, for example, an alcohol-based solvent such as water or methanol, any of various esters, any of various oils, or the like can be used as a single material, or a combination of the above-described mixture with a surfactant or the like can be used. The electrophoretic particle, as described above, is a particle (a macromolecule or a colloid) having such a characteristic that it moves to a desired electrode side through electrophoresis utilizing an electric potential difference in an electrophoretic dispersion medium. As the electrophoretic particle, a black pigment such as aniline black or carbon black, a white pigment such as titanium dioxide or aluminum oxide, a yellow pigment, red pigment, a blue pigment, or the like may be used. Such a particle can be used as a single type, or two or more types of particle described above may be used together. In this embodiment, as the electrophoretic particles, black particles having positive charge and white particles having negative charge are used. Alternatively, black particles having negative charge and white particles having positive charge may be used.

As a material composing the microcapsule 21, a compound having flexibility such as gum arabic, a gelatin-based compound, or a urethane-based compound is preferably used. The material of the binder 22 is not particularly limited, as long as it has good affinity to the microcapsule 21, superior adhesiveness for the electrodes, and an insulating property.

The second substrate 30 is formed from a thin film 31 having the transparent electrode layer 32 formed on the lower face thereof and is formed so as to cover the upper face of the electrophoretic layer 20. The transparent electrode layer 32 is a common electrode that faces the plurality of the pixel electrodes 13*a*. The thin film 31 is responsible for sealing and protecting the electrophoretic layer 20 and, for example, is configured by using a polyethylene terephthalate (PET) film. The thin film 31 is formed from a transparent material having an insulating property. The transparent electrode layer 32 is configured by using a transparent conductive film such as indium tin oxide film (ITO film) in which tin is doped. The circuit wiring of the first substrate 10 and the transparent electrode layer 32 of the second substrate 30 are connected together on the outer side of the area in which the electrophoretic layer 20 is formed. To be more specific, the transparent electrode layer 32 and the connection electrode 14 of the thin-film semiconductor circuit layer 12 are connected together through a conductive connection body 23.

Figure 3:
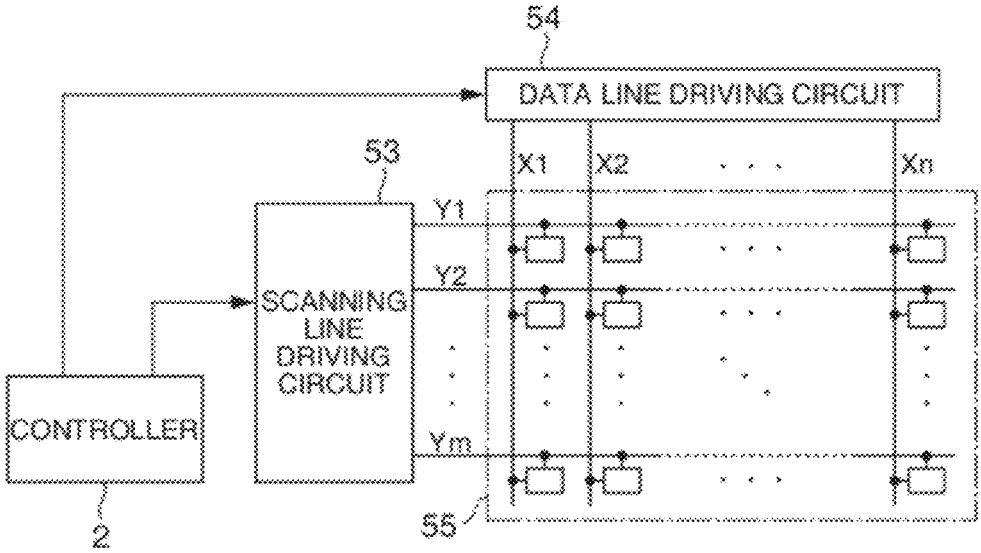
FIG. 3 is a schematic diagram illustrating the circuit configuration of a display unit.

FIG. 3 is a schematic diagram illustrating the circuit configuration of the display unit 1.

The controller 2 generates an image signal representing an image to be displayed in a display region 55, reset data used for a resetting operation at the time of rewriting an image, and other various signals (a clock signal and the like) and outputs the signals to a scanning line driving circuit 53 or a data line driving circuit 54. The display region 55 has a plurality of data lines arranged in the X direction so as to be parallel to one another, a plurality of scanning lines arranged in the Y direction so as to be parallel to one another, and pixel driving circuits that are arranged at the intersections of the data lines and the scanning lines.

Figure 4:
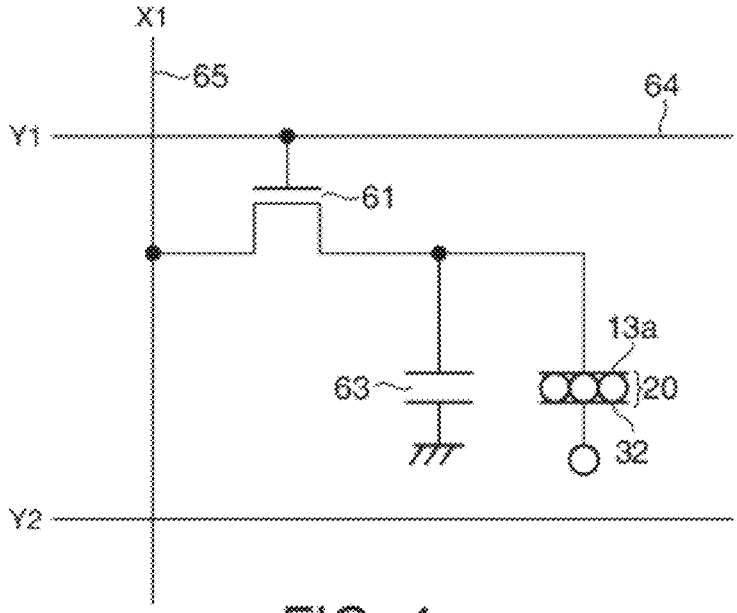
FIG. 4 is a diagram illustrating the configuration of each pixel driving circuit.

FIG. 4 is a diagram illustrating the configuration of each pixel driving circuit. In the pixel driving circuit, the gate of a transistor 61 is connected to a scanning line 64, the source thereof is connected to a data line 65, and the drain thereof is connected to a pixel electrode 13*a*. A storage capacitor 63 is connected so as to be in parallel with the electrophoretic element. Through the data line 65, driving voltages are applied to the pixel electrode 13*a* included in each pixel driving circuit and the transparent electrode layer 32, and whereby the electrophoretic particles included in the electrophoretic layer 20 are migrated. As a result, an image is displayed on the display unit 1.

The scanning line driving circuit 53 is connected to the scanning lines positioned in the display region 55, selects any one of the scanning lines, and supplies a predetermined scanning line signals Y1, Y2, . . . , Ym to the selected scanning line. These scanning line signals Y1, Y2, . . . , Ym are signals in which the active period (H-level period) is sequentially shifted. Thus, by outputting the scanning line signals to the scanning lines, the pixel driving circuits connected to the scanning lines are sequentially in the On-state. The data line driving circuit 54 is connected to the data lines positioned in the display region 55 and supplies data signals X1, X2, . . . , Xn to each pixel driving circuit that is selected by the scanning line driving circuit 53. To the pixel connected to the scanning line 64 that is in the selected state, a data signal is supplied from the data line 65 through the transistor 61. In the storage capacitor 63 that is included in the pixel, electric charge is accumulated in accordance with the data signal supplied to the pixel, and the electric potential of the pixel electrode 13*a* is an electric potential corresponding to the electric charge. The electrophoretic particles move between both electrodes in accordance with an electric potential difference (voltage) between the electric potential of the pixel electrode 13*a* and the electric potential of the transparent electrode layer 32, whereby the display state of the pixel changes, for example from black to white or from white to black. To be more specific, in this embodiment, since the black particles having positive electric charge and the white particles having negative electric charge are used as the electrophoretic particles, in a case where the electric potential of the pixel electrode 13*a* is higher than the electric potential of the transparent electrode layer 32, the black particles move to the transparent electrode layer 32 side, and the white particles move to the pixel electrode 13*a* side. On the other hand, in a case where the electric potential of the pixel electrode 13*a* is lower than the electric potential of the transparent electrode layer 32, the black particles move to the pixel electrode 13*a* side, and the white particles move to the transparent electrode layer 32 side. A period during which each scanning line 64 is selected once by the scanning line driving circuit 53 is referred to as a "frame period" (or simply referred to as a "frame"). Accordingly, each scanning line 64 is selected once during one frame, and a data signal is supplied to each pixel once during one frame.

In order to change the display state of each pixel from white to black or from black to white, the controller 2 changes the display state not by driving the pixel driving circuit for one frame but by driving the pixel driving circuit over a plurality of frames (four frames in this embodiment). The reason for this is that when the display state is to be changed from white to black, even when an electric potential is given to the electrophoretic particles only for one frame, the black electrophoretic particles do not completely move to the display side, whereby the display state is not completely black. This similarly applies to a case of the white electrophoretic particles where the display state is changed from black to white. Accordingly, for example, in a case where the display state of the pixel is to be changed from white to black, a data signal used for displaying black in the pixel is supplied to the pixel driving circuit over a plurality of frames. On the other hand, in a case where the display state of the pixel is to be changed from black to white, a data signal used for displaying white in the pixel is supplied over a plurality of frames.

Figure 5:
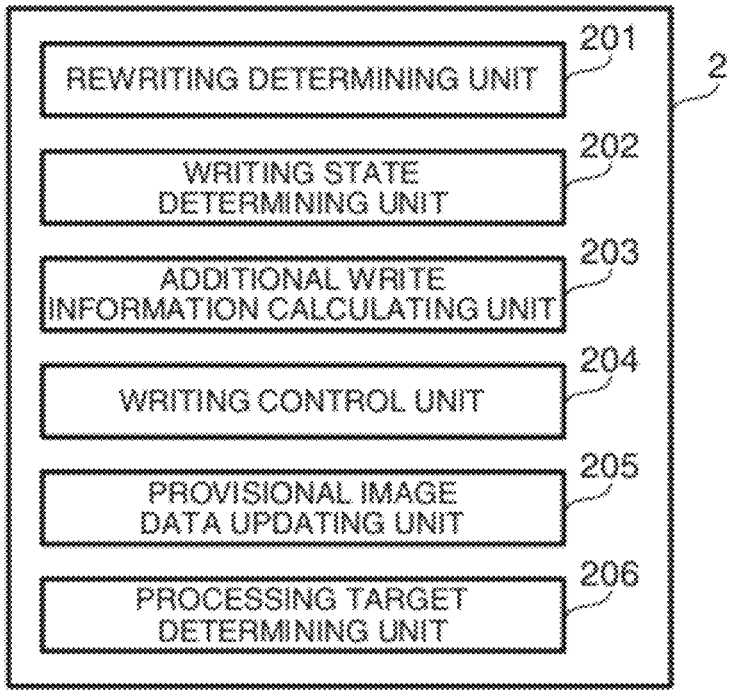
FIG. 5 is a block diagram showing a detailed configuration of a controller.

FIG. 5 is a block diagram showing the functional configuration of the controller 2. As shown in FIG. 5, the controller 2 includes a writing state determining unit 202, a rewriting determining unit 201, an additional write information calculating unit 203, a writing control unit 204, a provisional image data updating unit 205, and a processing target determining unit 206. The writing state determining unit 202, the rewriting determining unit 201, the additional write information calculating unit 203, the writing control unit 204, the provisional image data updating unit 205, and the processing target determining unit 206 correspond to functional blocks that are realized by a program executed by a processor of the controller 2.

The rewriting determining unit 201 determines whether a new writing instruction for one pixel is generated. Described in more detail, the rewriting determining unit 201 compares pixel data of the display image that is stored in the VRAM 4 and pixel data of the provisional image that is stored in the provisional image data storage area 7 with each other for one pixel. Then, the rewriting determining unit 201 determines whether or not the provisional image data storage area 7 needs to be updated or new writing occurs for the pixel based on the result of the comparison (rewriting determining process). Here, the pixel data of the display image that is stored in the VRAM 4 is the latest information. Accordingly, a case where the pixel data of the display image and the pixel data of the provisional image do not coincide with each other represents that an image having content different from the provisional image until now is instructed to be displayed. In other words, in a case where the pixel data of the display image and the pixel data of the provisional image do not coincide with each other, a state is formed in which a new writing instruction for the pixel is generated, that is, a state in which new writing for the pixel occurs, whereby the content of the provisional image data storage area 7 needs to be updated.

The writing state determining unit 202 determines whether or not a writing operation is in the middle of the process for one pixel by referring to the content of writing that is stored in the write information storage area 6 (writing state determining process). In a case where an update of the provisional image data storage area 7 is determined to be needed in the rewriting determining process, the additional write information calculating unit 203 calculates a difference between the pixel data of the display image that is stored in the VRAM 4 and the pixel data of the provisional image that is stored in the provisional image data storage area 7 and stores pixel data that is based on the calculated difference in the additional write information storage area 8 (additional write information calculating process).

The writing control unit 204 controls a process of registering information that represents the start of a writing operation, the continuation of a writing operation that is in the middle of the process, or that a pixel is a target for the application of a driving voltage based on the determination result of the writing state determining unit 202 (writing control process). The provisional image data updating unit 205 updates the provisional image data stored in the provisional image data storage area 7 with image data of a case where the writing control unit 204 has completed writing based on the content to be written that is stored in the write information storage area 6 (provisional image date updating process). The processing target determining unit 206 determines the storage area to be preferably referred to out of a plurality of write information storage areas 6 in a period for applying each driving voltage.

Next, the write information storage area 6 will be described in detail.

Four write information storage areas 6 are prepared, the number of the write information storage areas 6 corresponds to the number of times of applying a driving voltage that is necessary for changing the display state of the pixel from black to white or from white to black. In each of the four write information storage area 6, flag information that is used for identifying whether or not each pixel is a target for applying a driving voltage is stored. For example, in a case where the pixel is a target for applying a driving voltage, the flag information is On (first data). On the other hand, in a case where the pixel is not a target for applying a driving voltage, the flag information is Off (second data). In addition, in the write information storage area 6, information indicating either application of a driving voltage for changing the display state of each pixel from black to white or application of a driving voltage for changing the display state of each pixel from white to black is stored with being associated with the flag information. A case where one pixel is a target for applying a driving voltage represents that a writing operation for the pixel is in the middle of the process. On the other hand, a case where one pixel is not a target for applying a driving voltage represents that a writing operation for the pixel is not in the middle of the process. Accordingly, in the write information storage area 6, write information is stored which represents whether or not a writing operation for changing the display state of each pixel is in the middle of the process. Hereinafter, the flag information that is used for identifying whether or not a pixel is a target for applying a driving voltage and information that represents that the applying a driving voltage is used for changing the display state of the pixel from black to white are collectively referred to as first write information. In addition, the flag information that is used for identifying whether or not a pixel is a target for applying a driving voltage and information representing that the applying a driving voltage is used for changing the display state of the pixel from white to black are collectively referred to as second write information. Furthermore, the first write information and the second write information are collectively referred to as write information. In this embodiment, although the first color is black, and the second color is white, the kinds of the colors are not limited thereto. In this embodiment, since the black particles having positive charge and the white particles having negative charges are used as the electrophoretic particles, writing that is based on the first write information is performed by applying an electric potential lower than that of the transparent electrode layer 32 to the pixel electrode 13*a*. On the other hand, writing that is based on the second write information is performed by applying an electric potential higher than that of the transparent electrode layer 32 to the pixel electrode 13*a*.

Here, the reason for preparing the write information storage areas 6 corresponding to the number of times of applying a driving voltage necessary for changing the display state of the pixel is as follows.

The writing operation for changing the display state of a pixel, for example, from white to black includes an operation of supplying a data signal used for allowing the pixel to be displayed in black four times (in other words, an operation of applying a driving voltage to the pixel four times). In other words, the writing operation for changing the display state of the pixel, for example, from white to black includes four frame periods. The write information storage areas 6 are prepared in correspondence with the four frame periods. The writing control unit 204 sequentially refers to the write information storage areas 6 for each data signal supplying period (a period for applying a driving voltage to a pixel) and supplies a data signal to each pixel based on the content stored in the write information storage area 6 referred to. To be more specific, in a case where the flag information of a pixel is "On" in the write information storage area 6 to be referred to during the initial frame period out of four write information storage areas 6, and the display state of the pixel is changed from white to black, the writing control unit 204 supplies a data signal used for allowing the pixel to be displayed in black. Then, in a case where the flag information of the pixel is "On" in the write information storage area 6 to be referred to during the next frame period, and the display state of the pixel is changed from white to black, the writing control unit 204 supplies a data signal used for displaying black to the pixel again. When the referring to the four write information storage area 6 corresponding to the four frame periods is completed as above, the initial write information storage area 6 is the reference target again. As above, one write information storage area 6 corresponds to one frame period described above.

Figure 6:
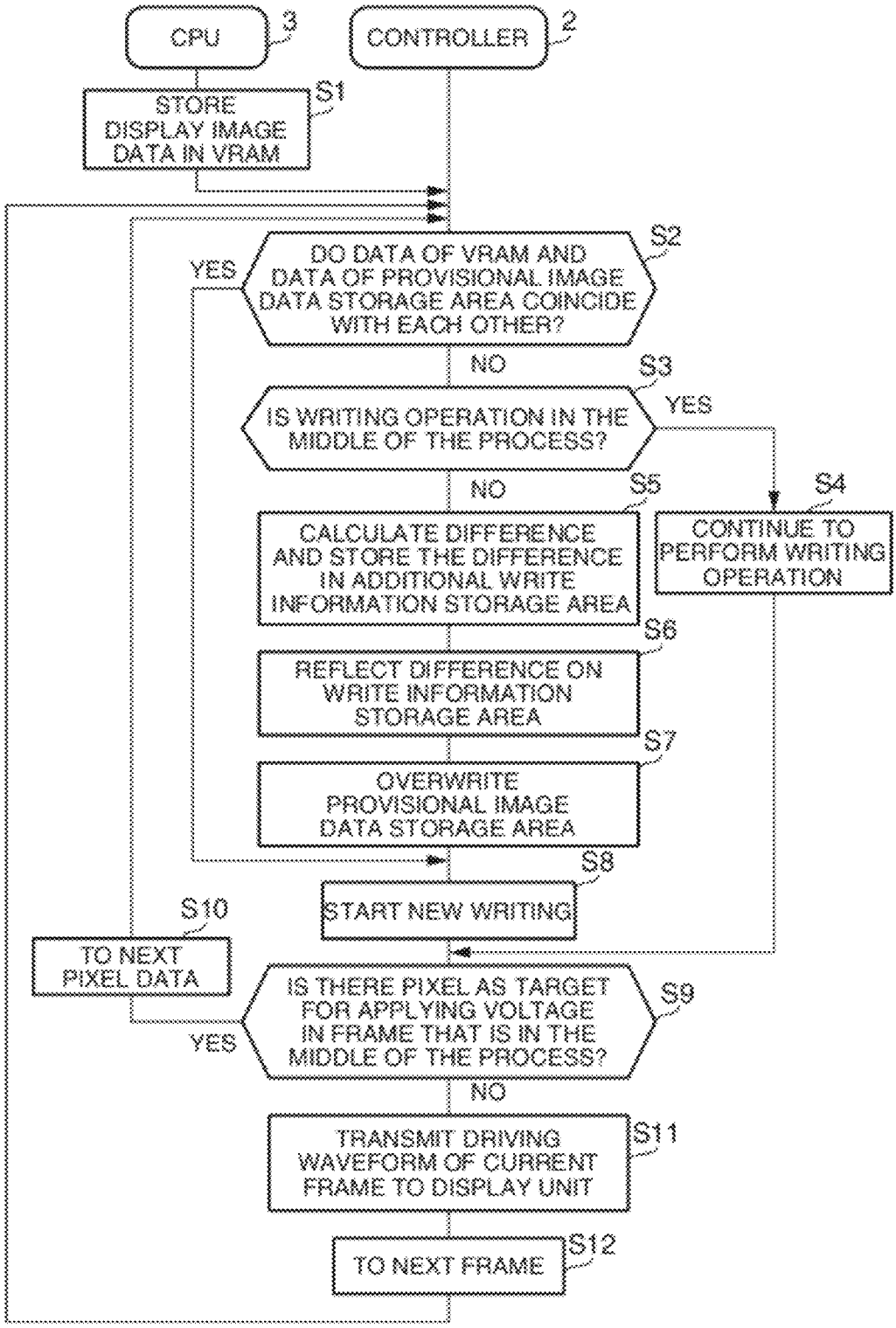
FIG. 6 is a flowchart illustrating an overview of the operation of an electrophoretic display device.

Next, the overview of the operation of the electrophoretic display device 100 will be described with reference to a flowchart shown in FIG. 6.

The CPU 3 stores display image data to be displayed on the display unit 1 in the VRAM 4 (Step S1: display image data updating process). The process performed by the CPU 3 in this Step S1 is randomly performed with being asynchronous to the process performed by the controller 2. In Step S2, the rewriting determining unit 201 compares pixel data of the display image stored in the VRAM 4 and pixel data of the provisional image stored in the provisional image data storage area 7 for one pixel (rewriting determining process). In a case where the pixel data of the display image and the pixel data of the provisional image are the same (Yes in Step S2), the writing control unit 204 starts a writing operation based on written content stored in the write information storage area 6 (Step S8: writing control process), and the process proceeds to Step S9. On the other hand, in a case where the pixel data of the display image and the pixel data of the provisional image are different from each other (No in Step S2), the writing state determining unit 202 determines whether a writing operation is in the middle of the process for the corresponding pixel data by referring to the first and second write information that are stored in the write information storage area 6 as a reference target (Step S3: writing state determining process). When the writing operation is in the middle of the process (Yes in Step S3), the writing control unit 204 continues the writing operation that is in the middle of the process (Step S4: writing control process) and proceeds to Step S9.

On the other hand, in a case where a writing operation is not in the middle of the process for the corresponding pixel data (No in Step S3), the additional write information calculating unit 203 calculates a difference between the pixel data of the display image that is stored in the VRAM 4 and the pixel data of the provisional image that is stored in the provisional image data storage area 7 and stores pixel data that is based on the difference in the additional write information storage area 8 (Step S5: additional write information calculating process). After Step S5, the writing control unit 204 registers write information for the target pixel in the write information storage area 6 based on the pixel data stored in the additional write information storage area 8 (Step S6: writing control process). Next, the provisional image data updating unit 205 updates the provisional image data stored in the provisional image data storage area 7 with the pixel data of the provisional image of the case where all the writing operations are completed by the writing control unit 204 based on the content of the writing that is stored in the write information storage area 6 (Step S7: provisional image data updating process). Then, the writing control unit 204 starts a writing operation based on the content of the writing that is stored in the write information storage area 6 (Step S8: writing control process) and thereafter proceeds to Step S9.

In Step S9, the processing target determining unit 206 determines whether there is an additional pixel as a target for applying a driving voltage in the write information storage area 6 as a reference target at the current time point (Step S9). In a case where there is an additional pixel as a target for applying a driving voltage in the frame as a processing target at the current time point (Yes in Step S9), the processing target determining unit 206 sets the pixel as a processing target to the next pixel in the same write information storage area 6 (Step S10) and returns the process to the process of Step S2. On the other hand, in a case where there is no pixel data as a target for applying a driving voltage in the write information storage area 6 of the reference target at the current time point (No in Step S9), the processing target determining unit 206 transmits an image signal and the like according to the current write information storage area 6 to the display unit 1 (Step S11) and sets the write information storage area 6 as a processing target to the next write information storage area 6 (Step S12).

Next, specific examples of the operation of the electrophoretic display device 100 will be described with reference to FIGS. 7 to 15. In FIGS. 7 to 15, a display image A represents the image state that is actually displayed on the display unit 1 at the current time point. Here, Pij (i is a row number, and j is a column number) represents one pixel. In each pixel Pij, a gray scale represented by five levels including "0" (black) to "4" (white) is denoted by a number.

As described above, in this embodiment, four frames are necessary for the change from white to black or black to white. Accordingly, the write information storage area 6 is configured by a total of four write information storage areas 6A to 6D corresponding to the frames. Here, numbers (1), (2), (3), and (4) attached to the write information storage areas 6A to 6D represent the order of being referenced to. In each of the VRAM 4 and the provisional image data storage area 7, a storage area Mij is arranged in which pixel data corresponding to the pixel Pij of the display unit 1 is stored. In the pixel data stored in the storage area Mij of the VRAM 4, a gray scale of each pixel of the display image is included. In addition, in the pixel data stored in the storage area Mij of the provisional image data storage area 7, a gray scale of each pixel of the provisional image is included. In the write information storage areas 6A to 6D, a storage area Mij is arranged in which the above-described write information corresponding to the pixel Pij of the display unit 1 is stored.

The controller 2 stores "1" in the pixel of which the display state is to be changed based on the image data stored in the VRAM 4 in the storage area Mij in the order of the write information storage area 6A, the write information storage area 6B, the write information storage area 6C, and the write information storage area 6D. When a writing operation is performed for the pixel Pij of the display unit 1 based on the write information that is stored in the write information storage area 6D, the process is returned to the beginning, and the write information storage area 6A is set as the write information recording area. Here, "1" shown in the figure represents that the flag information indicating a target for applying a driving voltage is "On" (this is the same in FIGS. 8 to 15). In the example shown in FIG. 7, since the pixels Pij (ij=11, 12, 21, and 22) are rewritten from white to black, "1" is stored in the storage areas Mij (ij=11, 12, 21, and 22) of the write information storage areas 6A to 6D. In such a case, since rewriting is performed from white to black, the write information that is stored in the storage area Mij (ij=11, 12, 21, or 22) corresponds to the above-described second write information.

Figure 7:
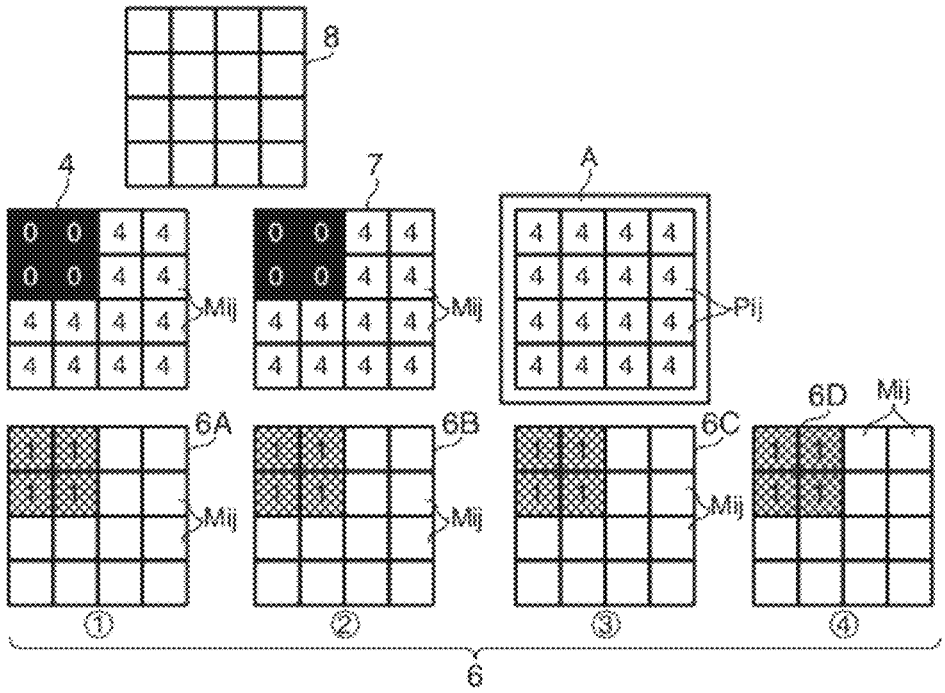
FIG. 7 is a diagram illustrating the operation of an electrophoretic display device.
Figure 8:
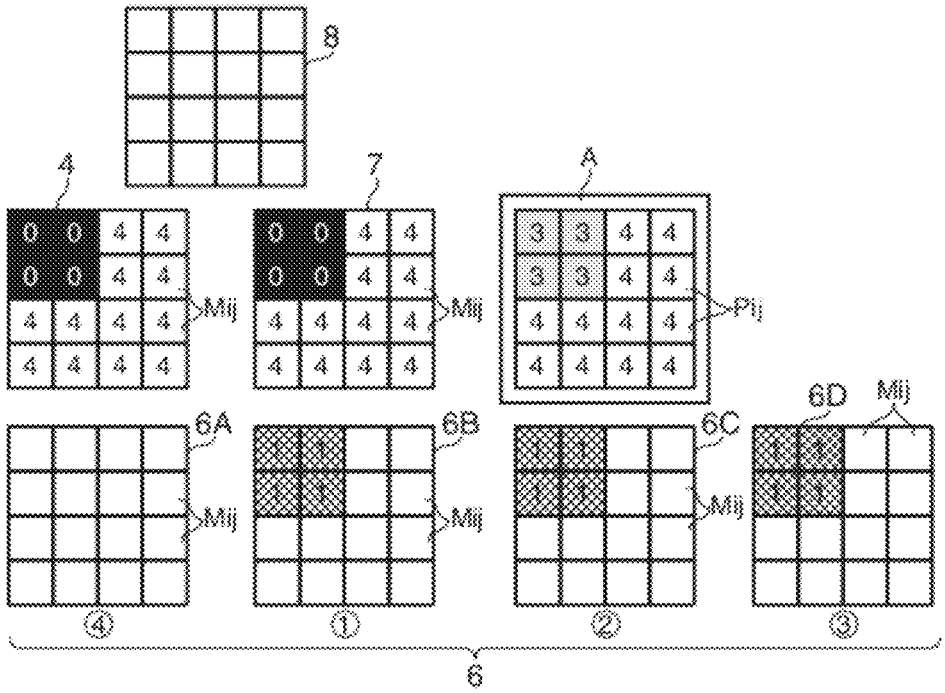
FIG. 8 is a diagram illustrating the operation of an electrophoretic display device.

FIG. 8 shows a state in which a writing operation corresponding to one frame has been completed from the state shown in FIG. 7. In FIG. 8, a state is formed in which the content of the write information storage area 6A shown in FIG. 7 is reflected on the pixel Pij (ij=11, 12, 21, or 22).

Figure 9:
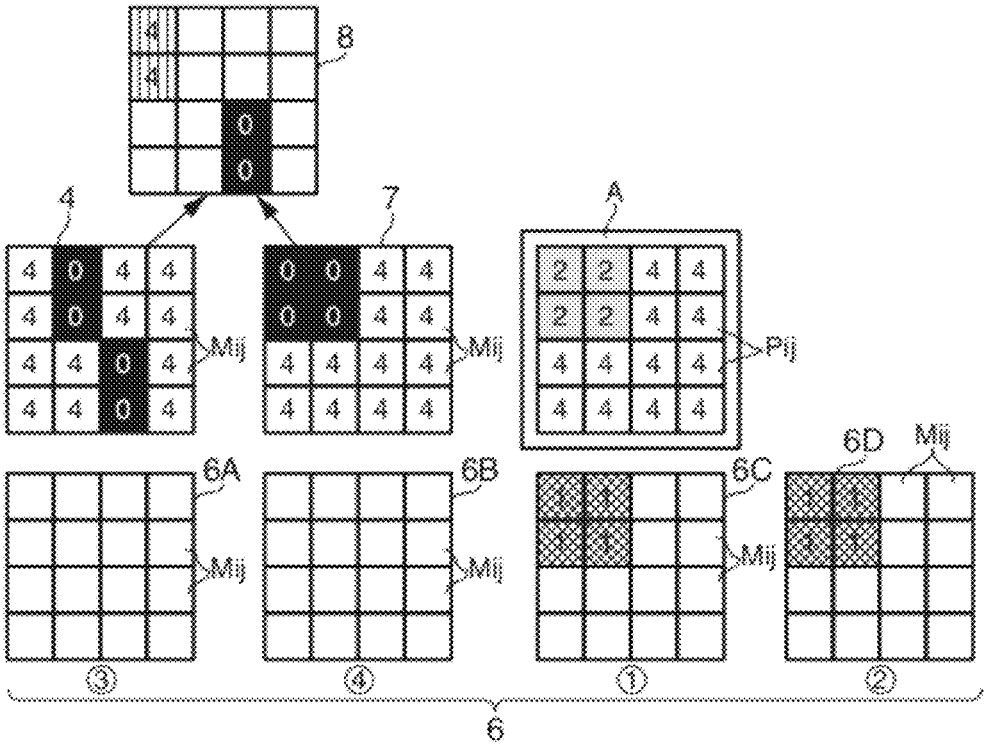
FIG. 9 is a diagram illustrating the operation of an electrophoretic display device.

FIG. 9 shows a state in which a writing operation corresponding to two frames is completed from the state shown in FIG. 7. In other words, a state is formed in which the content of the write information storage area 6B shown in FIG. 8 is reflected on the pixel Pij (ij=11, 12, 21, or 22). The image data stored in the VRAM 4 is updated as shown in FIG. 9 by the CPU 3 at this timing, and a case where a state is formed in which there is a difference between the image data stored in the VRAM 4 and the image data stored in the provisional image data storage area 7 will be considered.

In FIG. 9, the rewriting determining unit 201 compares the pixel data that is stored in each storage area Mij of the VRAM 4 and the pixel data that is stored in each storage area Mij of the provisional image data storage area 7 for each pixel Pij. As a result, the rewriting determining unit 201 determines that both the pixel data of the VRAM 4 and the pixel data of the provisional image data storage area 7 to be different from each other for the storage areas Mij (ij=11, 12, 33, or 43) and to be the same for other storage areas (rewriting determining process). Next, the writing state determining unit 202 refers to the write information in each storage area Mij that is stored in the write information storage area 6A to 6D for each pixel Pij. As a result, the writing state determining unit 202 determines the pixels Pij (ij=11, 12, 21, and 22) to be in the middle of a writing operation and determines the other pixels not to be in the middle of a writing operation (writing state determining process). Accordingly, for the pixels Pij (ij=11, 12, 21, and 22) for which writing operations are in the middle of the process, the writing operation that is in the middle of the process is continued by the writing control unit 204 (writing control process).

Next, the additional write information calculating unit 203 calculates a difference between the pixel data stored in each storage area Mij of the VRAM 4 and the pixel data stored in each storage area Mij of the provisional image data storage area 7 based on the above-described comparison performed in the rewriting determining process and stores pixel data that is based on the calculated difference in the additional write information storage area 8 (additional write information calculating process).

As a method of comparing the pixel data that is stored in each storage area Mij of the VRAM 4 and each storage area Mij of the provisional image data storage area 7 and calculating a difference thereof by using the additional write information calculating unit 203, for example, there is a method described as below. The additional write information calculating unit 203 recognizes black as "0" and white as "1" in each pixel data of the image data stored in the VRAM 4 and the image data stored in the provisional image data storage area 7. Then, the additional write information calculating unit 203 calculates a difference thereof by using the following Equation (a).

difference=Image data stored in VRAM 4 XOR image data stored in provisional image data storage area 7 Equation (a)

As shown in FIG. 9, the additional write information calculating unit 203 stores the pixel data of the calculated difference in the additional write information storage area 8.

The writing control unit 204 updates the content of the write information storage area 6 based on the image data stored in the additional write information storage area 8 (writing control process). To be more specific, since the pixels Pij (ij=33 and 43) need to be rewritten from white to black, the writing control unit 204 registers information that indicates a target for applying a driving voltage used for changing the display state from white to black as the second write information in each storage area Mij (ij=33 or 43) of the write information storage areas 6A to 6D. In addition, although the pixels Pij (ij=11 and 21) need to be rewritten from black to white, the pixels Pij (ij=11 and 21) are determined to be in the middle of a writing operation by the writing state determining unit 202, and accordingly, the storage areas Mij (ij=11 and 21) corresponding to the pixels Pij (ij=11 and 21) of the write information storage area 6 are not updated at this time point.

Next, the provisional image data updating unit 205 updates the storage area Mij of the provisional image data storage area 7 with the pixel data of the case where the writing control unit 204 completes writing based on the content to be written that is stored in the write information storage area 6 (provisional image data updating process). As a result of the writing control process and the provisional image data updating process, the write information storage areas 6A to 6D and the provisional image data storage area 7 are in the state shown in FIG. 10.

Figure 10:
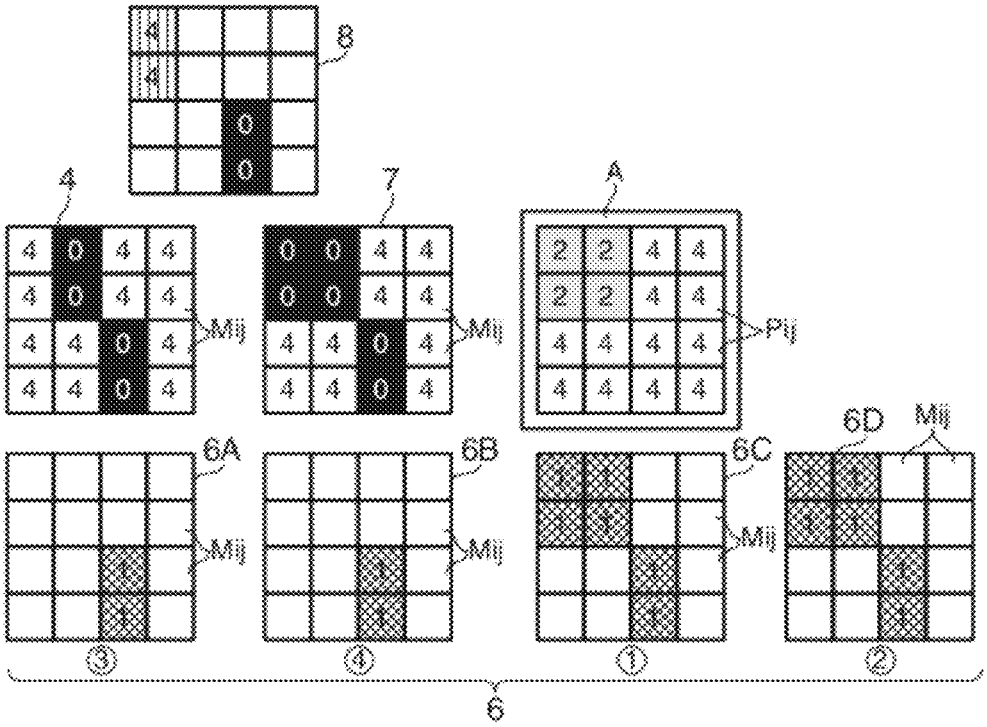
FIG. 10 is a diagram illustrating the operation of an electrophoretic display device.

In FIG. 10, the writing control unit 204 continues to perform the writing operations that are in the middle of the process for the pixels Pij (ij=11, 12, 21, and 22) based on the information stored in the write information storage area 6C after update and starts new writing operations for the pixels Pij (ij=33 and 43) (write control process). As above, in a case where the image data stored in the VRAM 4 is rewritten from the state shown in FIG. 8 to the state shown in FIGS. 9 and 10, even when the writing operations for the pixel Pij (ij=11, 12, 21, and 22), which are performed based on the image data of the VRAM 4 shown in FIG. 8, are continued, a writing operation, which is performed based on the image data of the VRAM 4 shown in FIGS. 9 and 10, can be started for a part of the pixels (Pixel Pij=(33, 43)). Accordingly, the sensed response speed can be improved.

Figure 11:
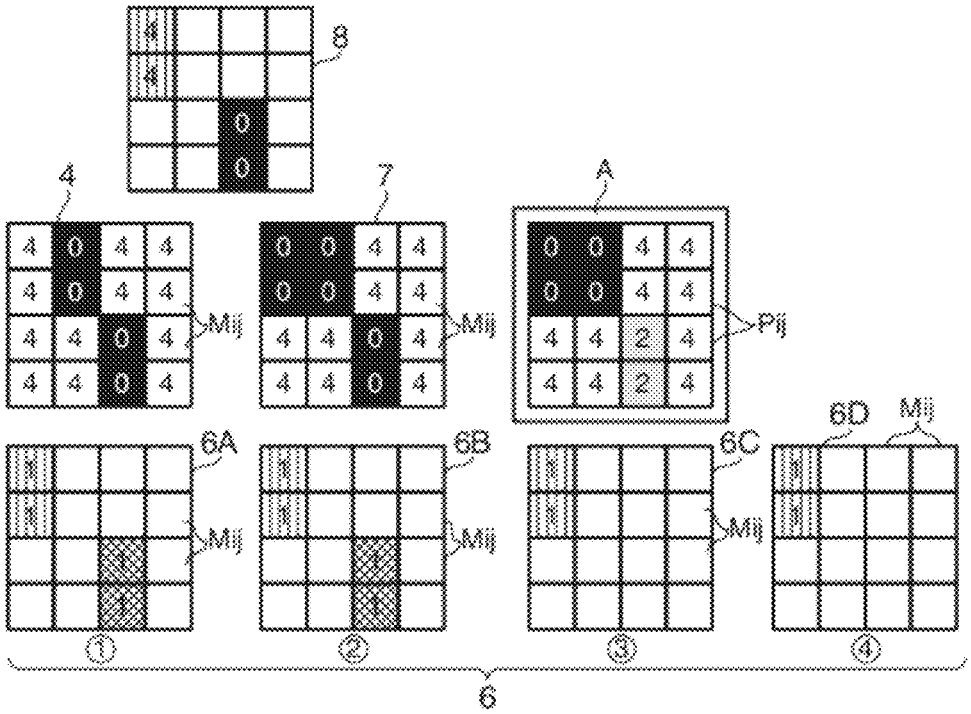
FIG. 11 is a diagram illustrating the operation of an electrophoretic display device.

FIG. 11 shows a state at a time point when a writing operation corresponding to two frames is completed from the state shown in FIG. 10. As shown in the figure, writing operations for changing the display state from white to black are completed for the pixels Pij (ij=11, 12, 21, and 22), and writing operations for changing from white to black are in the middle of the process for the pixels Pij (ij=33 and 43). In addition, FIG. 11 shows a state in which the writing control unit 204 has completed updating the write information storage area 6 based on the pixel data stored in the additional write information storage area 8. To be more specific, since writing operations for changing the display state from black to white need to be performed for the pixels Pij (ij=11 and 21), the writing control unit 204 registers the first write information for the storage areas Mij (ij=11 and 21) of the write information storage areas 6A to 6D.

Figure 12:
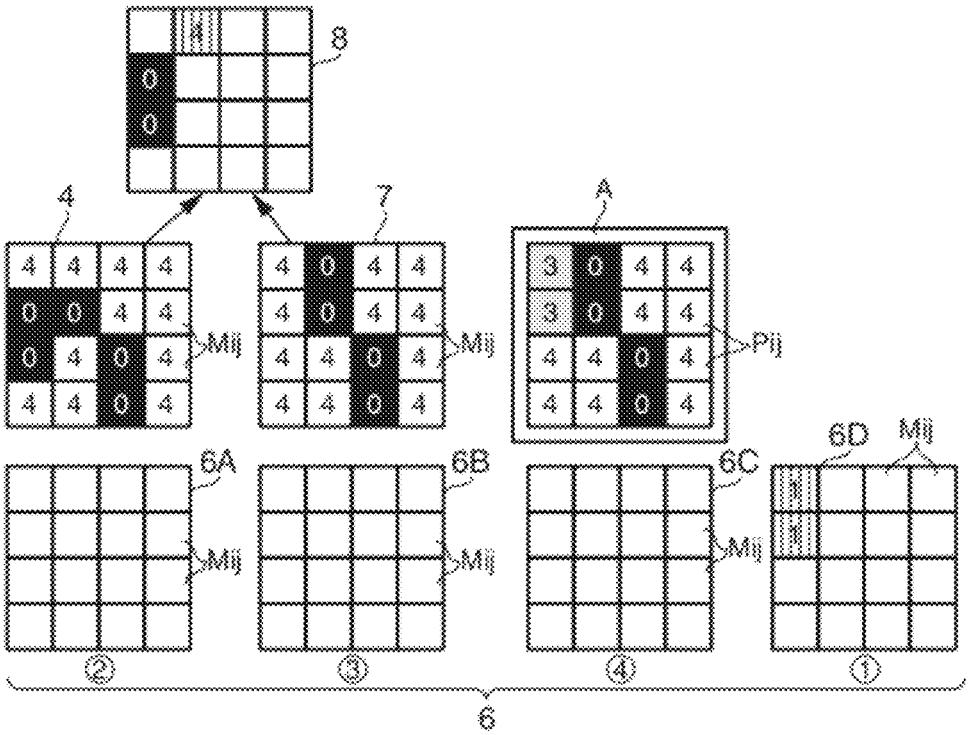
FIG. 12 is a diagram illustrating the operation of an electrophoretic display device.

FIG. 12 shows a state at a time point when writing operations corresponding to three frames are completed from the state shown in FIG. 11. As shown in the figure, the writing operations are completed for the pixels Pij (ij=33 and 43). The VRAM 4 is updated as shown in the figure by the CPU 3 at this timing, and a case where there is a difference between the image data stored in the VRAM 4 and the image data stored in the provisional image data storage area 7 will be considered.

As shown in FIG. 12, the writing state determining unit 202 refers to the write information in each storage area Mij that is stored in the write information storage areas 6A to 6D for each pixel Pij. As a result, the writing operation are determined to be in the middle of the process for the pixels Pij (ij=11 and 21), and a writing operation is determined not to be in the middle of the process for the other pixels (writing state determining process). Accordingly, for the pixels Pij (ij=11 and 21) for which the writing operations are in the middle of the process, the writing operations that are currently in the middle of the process are continued by the writing control unit 204 (writing control process).

In addition, as shown in FIG. 12, the rewriting determining unit 201 compares the pixel data stored in the storage area Mij of the VRAM 4 and the pixel data stored in the storage area Mij of the provisional image data storage area 7 with each other for each pixel Pij. As a result, the rewriting determining unit 201 determines the pixel data of the VRAM 4 and the pixel data of the provisional image data storage area 7 to be different from each other for the pixels Pij (ij=12, 21, and 31) and determines the above-described data to be the same for the other pixels (rewiring determining process). Next, the writing state determining unit 202 refers to the write information of each storage area Mij stored in the write information storage areas 6A to 6D for each pixel Pij. As a result, the writing state determining unit 202 determines writing operations for the pixels Pij (ij=11 and 21) to be in the middle of the process and determines a writing operation for the other pixels not to be in the middle of the process (writing state determining process). Next, based on the result of the above-described comparison performed in the rewriting determining process, the additional write information calculating unit 203 calculates a difference between the image data stored in the storage area Mij of the VRAM 4 and the image data stored in the storage area Mij of the provisional image data storage area 7 and stores image data, which is based on the calculated difference, in the additional write information storage area 8.

The writing control unit 204 updates the write information storage area 6 based on the image data stored in the additional write information storage area 8 (writing control process). To be more specific, since the pixel Pij (ij=12) needs to be rewritten from black to white, the writing control unit 204 registers the first write information in each storage area Mij (ij=12) of the write information storage areas 6A to 6D. In addition, since the pixel Pij (ij=31) needs to be rewritten from white to black, the writing control unit 204 registers the second writing information for each storage area Mij (ij=31) of the write information storage areas 6A to 6D. In addition, although the pixel Pij (ij=21) needs to be rewritten from white to black, the pixel Pij (ij=21) is determined to be in the middle of a writing operation by the writing state determining unit 202, and accordingly, the storage area Mij (ij=21) corresponding to the pixel Pij (ij=21) of the write information storage area 6 is not updated at this time point.

Next, the provisional image data updating unit 205 updates the storage area Mij of the provisional image data storage area 7 with the pixel data of a case where the writing control unit 204 has completed all the writing operations based on the content to be written that is stored in the write information storage area 6 (provisional image data updating process). As a result, the write information storage areas 6A to 6D and the provisional image data storage area 7 are in the state shown in FIG. 13.

Figure 13:
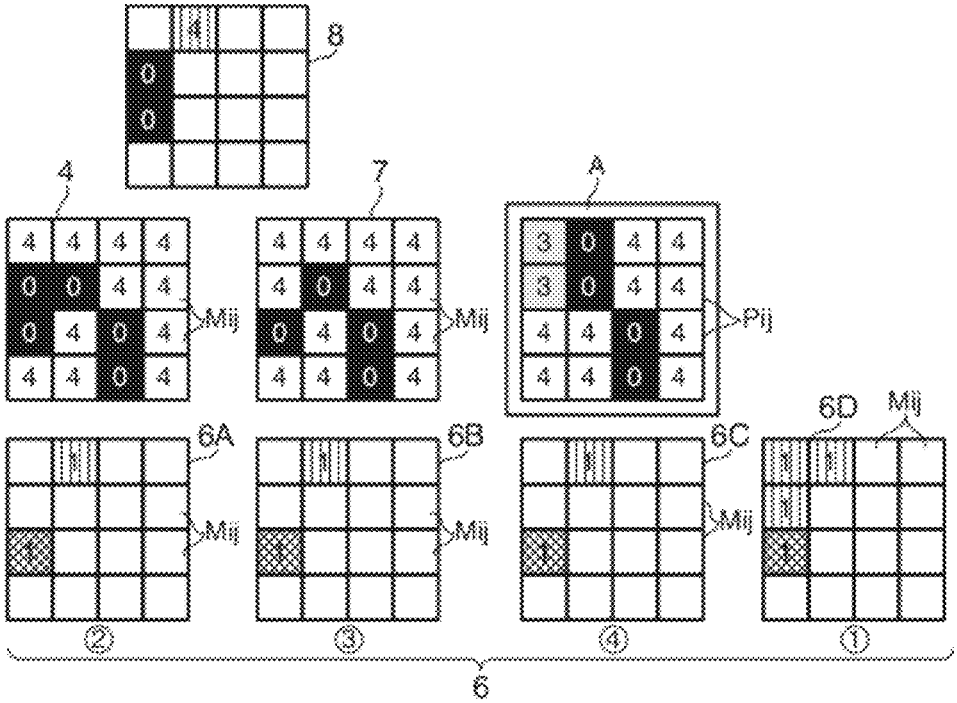
FIG. 13 is a diagram illustrating the operation of an electrophoretic display device.

As shown in FIG. 13, the writing control unit 204 continues to perform the writing operations that are in the middle of the process for the pixels Pij (ij=11 and 21) and starts new writing operations for the pixels Pij (ij=12 and 31), based on the information stored in the write information storage area 6D after update (writing control process).

Figure 14:
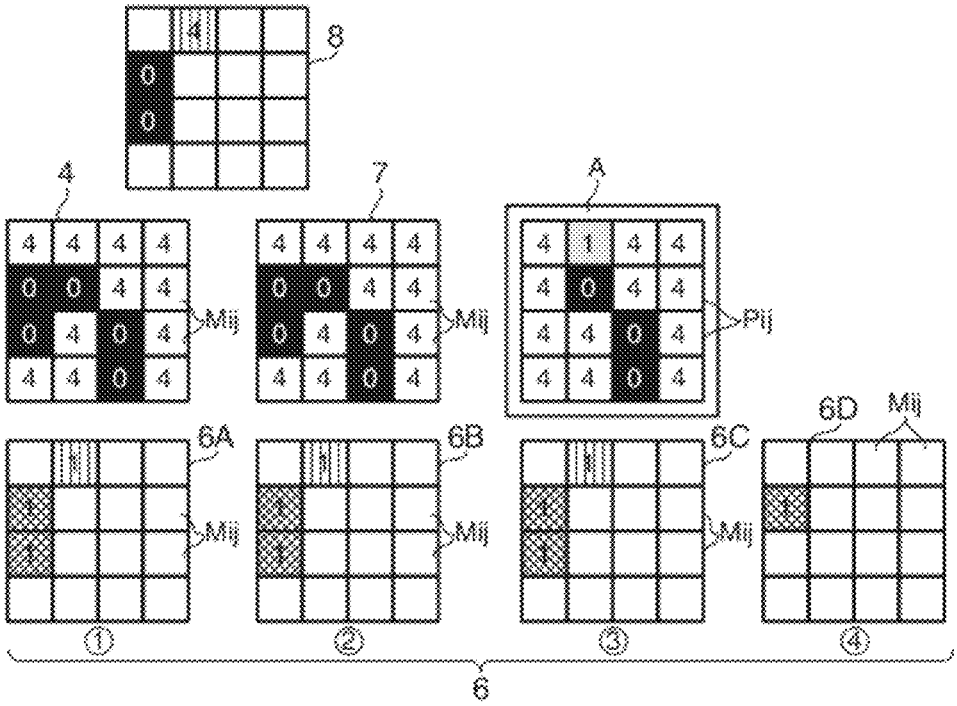
FIG. 14 is a diagram illustrating the operation of an electrophoretic display device.

FIG. 14 shows a state at a time point when a writing operation corresponding to one frame is completed from the state shown in FIG. 13. As shown in the figure, a writing operation for changing the display state from black to white is completed for the pixels Pij (ij=11 and 21) and a writing operation for changing the display state from black to white is in the middle of the process for the pixel Pij (ij=12). In addition, FIG. 14 shows a state in which the write information storage area 6 has been completely updated based on the image data stored in the additional write information storage area 8 by the writing control unit 204. To be more specific, since the pixel Pij (ij=21) needs to be written from white to black, the writing control unit 204 registers the second write information in each storage area Mij (ij=21) of the write information storage areas 6A to 6D (writing control process). In addition, the provisional image data updating unit 205 updates the provisional image data stored in the provisional image data storage area 7 with the pixel data of the case where all the writing operations are completed by the writing control unit 204 based on the content to be written that is stored in the write information storage area 6 based on the content of the updated write information storage area 6 (provisional image data updating process).

Figure 15:
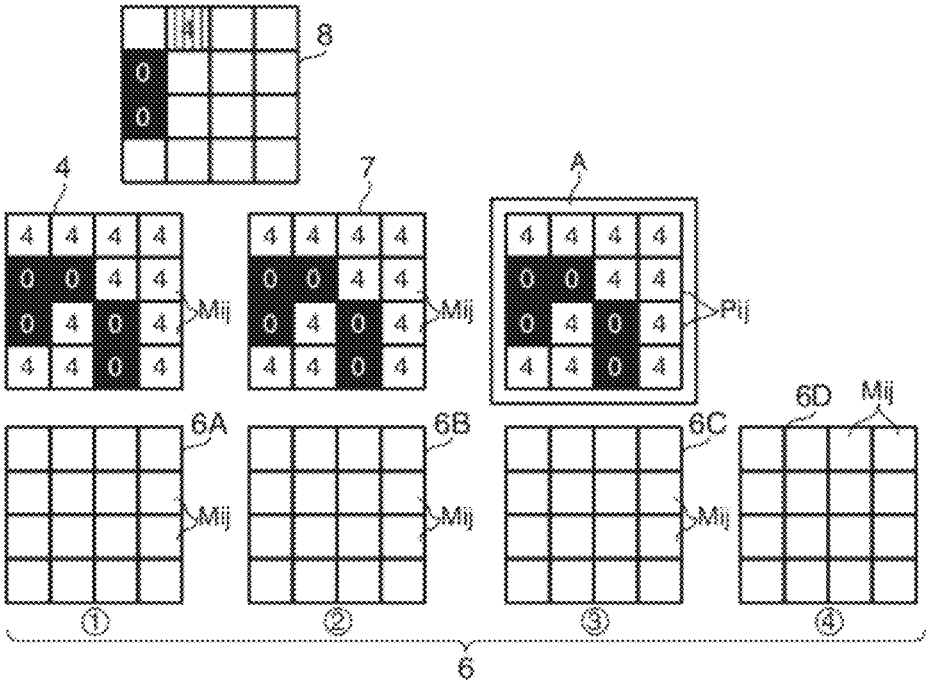
FIG. 15 is a diagram illustrating the operation of an electrophoretic display device.

FIG. 15 shows a state at a time point when writing operations corresponding to four frames are completed from the state shown in FIG. 14. As shown in the figure, since all the writing operations are completed, the image data of the display image A is the same as the image data stored in the VRAM 4.

As above, according to this embodiment, it is determined whether a writing operation is currently performed in units of a pixel, and a new writing operation is started as needed from a pixel for which a writing operation is completed. Accordingly, in an electrophoretic display device that requires relatively long time for rewriting an image, a sensed response speed of an image display can be improved.

In addition, in a general method in which a writing operation is performed in units of a partial area including a plurality of pixels, in a case where partial areas overlap with each other in part, the partial area for which the writing operation is started later needs to wait so as to be driven until the writing operation, for the partial area for which the writing operation is started first, is completed. However, according to this embodiment, even for the partial area for which the writing operation is started later, a writing operation can be immediately started for pixels of a portion that does not overlap the partial area for which the writing operation is started first. In other words, even in a display in which a plurality of graphics overlap one another, a writing operation is started without waiting for the completion of the previous writing operation for at least a part of the portion for which the writing operation is started later. Therefore, a sensed response speed can be improved.

In addition, according to this embodiment, only by writing image data into the VRAM 4 by using the CPU 3, the controller 2 controls the display operation of the display unit 1. Accordingly, a developer of an application for the electrophoretic display device can generate applications more efficiently. To be more specific, an application can be generated by using the same technique as that of a general display device such as a liquid crystal or a CRT (Cathode Ray Tube) without designating a write area or performing a drawing start command, unlike a controller for a general electrophoretic display device.

In addition, according to this embodiment, when a new writing operation is performed for each pixel, the content of the provisional image data storage area 7 is allowed to coincide with the content of the VRAM 4 such that a period generated due to a time difference is extremely short. Accordingly, as long as the data of the VRAM 4 and the data of the provisional image data storage area 7 coincide with each other, no rewriting target is detected, and therefore, an unnecessary writing operation can be excluded.

In addition, for a pixel for which the start of a new writing operation is delayed due to a writing operation that is currently performed, the data of the pixel is compared with the pixel data stored in the VRAM 4 at a time point when the writing operation is completed. Accordingly, the latest state of the VRAM 4 can be reflected all the time.

Figure 16A:
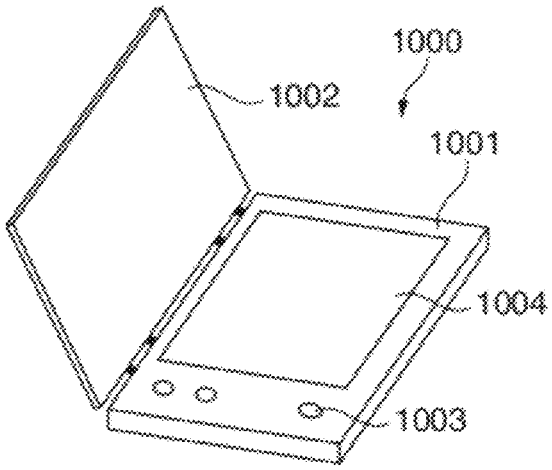
FIGS. 16A to 16C are diagrams illustrating applications of a display device according to an embodiment of the invention.
Figure 16B:
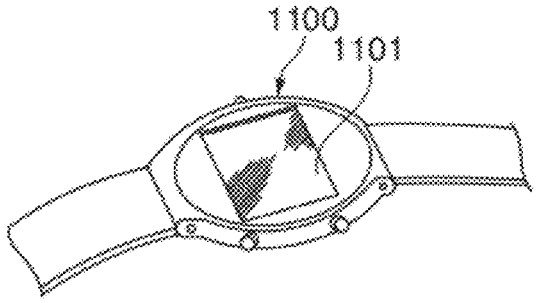
Figure 16C:
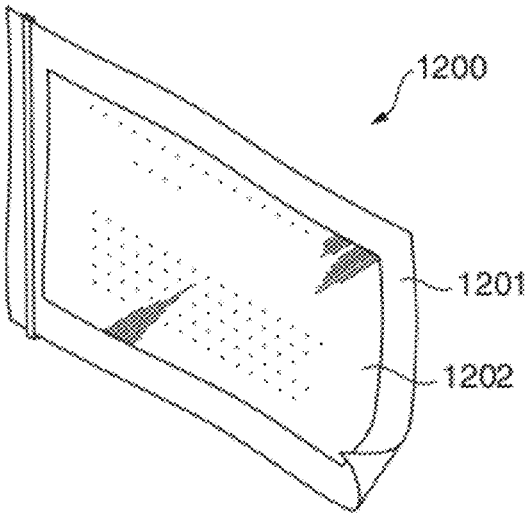

FIGS. 16A to 16C are perspective views illustrating applications of a display device according to an embodiment of the invention.

FIG. 16A is a perspective view showing an electronic book. This electronic book 1000 includes a book-shaped frame 1001, a cover 1002 that is disposed so as to freely turnable (to be able to be opened or closed) with respect to the frame 1001, an operation unit 1003, and a display unit 1004 that is configured by a display device according to an embodiment of the invention.

FIG. 16B is a perspective view showing a wrist watch. This wrist watch 1100 includes a display unit 1101 that is configured by a display device according to an embodiment of the invention.

FIG. 16C is a perspective view of an electronic paper apparatus. This electronic paper apparatus 1200 includes a main body unit 1201 that is configured by a rewritable sheet that has the same texture and flexibility as those of a paper sheet and a display unit 1202 that is configured by a display device according to an embodiment of the invention.

The applications of a display device according to an embodiment of the invention are not limited thereto, and the applications broadly include apparatuses using a visual change in the color tone, which is accompanied with movements of charged particles, such as a personal computer, a PDA, or a cellular phone.

The above-described embodiment can be modified as below. In addition, modified examples described below can be performed by being appropriately combined together.

Modified Example 1

In this embodiment, although the controller 2 includes the rewriting determining unit 201 and the provisional image data updating unit 205, the rewriting determining unit 201 and the provisional image data updating unit 205 may be realized as the functions of the CPU 3. In such a case, the controller 2 does not need to refer to the content of the VRAM 4.

Modified Example 2

In addition, in this embodiment, a case is assumed in which a black and white display is performed by using two types of black and white electrophoretic particles including one type having positive electric charge and the other type having negative electric charge as electrophoretic particles. However, an embodiment of the invention can be applied not only to the black and white display but also to a display on the basis of density changes in two directions such as a red-and-white, blue-and-black, or the like on the basis of density differences.

Modified Example 3

In addition, the configuration of the display unit 1 is not limited to those shown in FIGS. 2 to 4. For example, the configuration of the electrophoretic layer is not limited to the configuration that includes a plurality of microcapsules and may be a configuration in which an electrophoretic dispersion medium and electrophoretic particles are included in spaces divided by a partition wall.

In addition, in the description presented above, the electrophoretic display device 100 having the electrophoretic-type display unit 1 has been described as an example of the display device. However, the display type of the display unit 1 is not limited to the electrophoretic type. The display type of the display unit 1 may be a type that is a relative slow display type and is controlled by using a method of applying a voltage for a plurality of frames until the completion of a display. For example, a cholesteric liquid crystal, an electrochromic, an electron power fluid, or the like may be used.

Modified Example 4

In addition, an embodiment of the invention can be applied to an electrophoretic display device in which the electrophoretic particles are moved by controlling only the electric potential of the pixel electrode to have a high electric potential or a low electric potential (bipolar driving) or an electrophoretic display device in which the electric potentials of both the pixel electrode and the common electrode are controlled to have a high electric potential and a low electric potential (unipolar driving).

Modified Example 5

In addition, the controller 2 and the CPU 3 may be mounted on different devices or may be mounted on one chip such as an SOC (System-On-A-Chip).

Modified Example 6

When there is no pixel data as a target for applying a driving voltage in the write information storage area 6, and the content of the VRAM 4 and the content of the provisional image data storage area 7 coincide with each other, in other words, when the applying of a voltage is not necessary for the time being, the process may proceed to another state such as a power-saving state until new image data is transmitted from the outside.

It may be configured such that coordinates of a rectangular area in which a pixel having its flag information in the On state is included are stored each time a new writing operation is performed (for example, each time when the image data of the VRAM 4 is changed by the CPU 3), and, when the writing operation for the stored rectangular area is completed, the flag information for a portion not overlapping a rectangular area that has been newly set due to a new writing operation performed thereafter is reset to Off. Here, the rectangular area may have another shape as a circular area, an oval area, or the like.

In the unipolar driving, after a voltage for writing white is applied a predetermined number of times, a voltage for writing black may be applied a predetermined number of times, or a black voltage and a white voltage may be alternately applied a predetermined number of times. In addition, a ratio between the number of times of applying a voltage for writing white and the number of times of applying a voltage for writing black may be changed.

In the above-described embodiment, the write information storage area 6 and the provisional image data storage area 7 are configured as independent different faces (the planar type). However, the write information storage area 6 and the provisional image data storage area 7 may not be handled as different faces, but one face may be configured in the state in which both are put together (the packed pixel type).

Modified Example 7

In the embodiment, although the write information storage areas 6 corresponding to the number of times of applying a driving voltage that is necessary for changing the display state of each pixel are prepared, the number of the write information storage areas 6 may be at least the number of times of applying a driving voltage or more. For example, in a case where the number of times of applying a driving voltage is four, the number of the write information storage areas 6 may be five. Even in a case where the number of the write information storage areas 6 is more than the number of times of applying a driving voltage as above, the write information storage areas 6 are used in a cyclic manner like a so-called ring buffer. Accordingly, the number of the write information storage areas 6 that are substantially used in one writing process is the same as the number of times of applying a driving voltage. Therefore, the principle that write information used for identifying one pixel as a target for applying a driving voltage is stored in each of the write information storage areas 6 corresponding to the number of times of applying a driving voltage when the display state of the pixel is changed from the first display state to the second display state, the write information storage areas 6 are sequentially referred to, and a driving voltage is applied to one pixel a plurality of times based on the write information stored in the write information storage area 6 in this modified example is the same as that of the embodiment.

The entire disclosure of Japanese Patent Application No. 2010-183337, filed Aug. 18, 2010 is expressly incorporated by reference herein.

What is claimed is:

1. A control device for a display device in which a display unit including a plurality of scanning lines, a plurality of data lines, and a plurality of pixels are included, and writing for changing a display state of each of the pixels from a first display state to a second display state is performed by an operation of applying a driving voltage to the each of the pixels a plurality of times, the control device comprising:

a rewriting determining unit that determines whether or not a new writing instruction is generated for one pixel out of the plurality of the pixels;

a writing state determining unit that determines whether or not a writing operation is in the middle of the process for the one pixel in a case where the new writing instruction is determined to be generated;

a writing control unit that, in a case where the writing operation for the one pixel is determined not to be in the middle of the process by the writing state determining unit, stores write information used for identifying that the one pixel is a target for applying a driving voltage in each of first storage areas, wherein the number of first storage areas corresponds to a number of frames that a driving voltage is continually supplied to change the display state of the pixel from the first display state to the second display state, sequentially refers to the first storage areas, and applies the driving voltage to the one pixel a plurality of times based on the write information that is stored in the first storage areas and, in a case where the writing operation is determined to be in the middle of the process for the one pixel by the writing state determining unit, continues to perform the writing operation that is in the middle of the process and performs the writing control after the writing operation is completed;

a display image data updating unit that stores pixel data of a display image displayed on the display unit in a second storage area based on display image data that is input; and a provisional image data updating unit that stores pixel data of a provisional image to be displayed on the display unit by the writing operation that is in the middle of the process in a third storage area, wherein the provisional image data updating unit updates pixel data of the one pixel with pixel data corresponding to the pixel data of the provisional image of a case where the driving voltage is applied based on all the write information stored in the first storage areas at a timing when writing, which is based on the new writing instruction, is started for the one pixel, and wherein the rewriting determining unit determines that the new writing instruction is generated for the one pixel in a case where the pixel data of the display image that is stored in the second storage area and the pixel data of the provisional image that is stored in the third storage area are different from each other.

2. The control device according to claim 1, wherein the writing state determining unit determines that the writing operation is in the middle of the process for the one pixel in a case where the write information used for identifying that the one pixel is a target for applying a driving voltage is stored in the first storage area referred to.

3. The control device according to claim 1, further comprising an additional write information calculating unit that, in a case where the pixel data of the display image that is stored in the second storage area and the pixel data of the provisional image that is stored in the third storage area are different from each other, calculates pixel data of an additional writing image that is a difference between the pixel data of the display image and the pixel data of the provisional image by performing a logic operation for the pixel data of the display image and the pixel data of the provisional image and stores the pixel data of the additional writing image in a fourth storage area, wherein the writing control unit updates the write information that is stored in the first storage areas based on the pixel data of the additional writing image that is stored in the fourth storage area.

4. The control device according to claim 1, wherein the write information that is stored in the first storage areas includes:

first write information that indicates writing for changing the display state of the one pixel from a state representing a first color to a state representing a second color; and second write information that indicates writing for changing the display state of the one pixel from the state representing the second color to the state representing the first color.

5. A display device in which a display unit including a plurality of scanning lines, a plurality of data lines, and a plurality of pixels are included, and writing for changing a display state of each of the pixels from a first display state to a second display state is performed by an operation of applying a driving voltage to the each of the pixels a plurality of times, the display device comprising:

a rewriting determining unit that determines whether or not a new writing instruction is generated for one pixel out of the plurality of the pixels;

a writing state determining unit that determines whether or not a writing operation is in the middle of the process for the one pixel in a case where the new writing instruction is determined to be generated;

a writing control unit that, in a case where the writing operation for the one pixel is determined not to be in the middle of the process in the determining of whether or not the writing operation is in the middle of the process, performs writing control of storing write information used for identifying that the one pixel is a target for applying a driving voltage in each of first storage areas, wherein the number of first storage areas corresponds to number of frames that a driving voltage is continually supplied to change the display state of the pixel from the first display state to the second display state, sequentially referring to the first storage areas, and applying the driving voltage to the one pixel a plurality of times based on the write information that is stored in the first storage areas and, in a case where the writing operation is determined to be in the middle of the process for the one pixel in the determining of whether or not the writing operation is in the middle of the process, continues to perform the writing operation that is in the middle of the process and performs the writing control after the writing operation is completed;

a display image data updating unit that stores pixel data of a display image displayed on the display unit in a second storage area based on display image data that is input; and a provisional image data updating unit that stores pixel data of a provisional image to be displayed on the display unit by the writing operation that is in the middle of the process in a third storage area, wherein the provisional image data updating unit updates pixel data of the one pixel with pixel data corresponding to the pixel data of the provisional image of a case where the driving voltage is applied based on all the write information stored in the first storage areas at a timing when writing, which is based on the new writing instruction, is started for the one pixel, and wherein the rewriting determining unit determines that the new writing instruction is generated for the one pixel in a case where the pixel data of the display image that is stored in the second storage area and the pixel data of the provisional image that is stored in the third storage area are different from each other.

6. The display device according to claim 5, wherein the writing state determining unit determines that the writing operation is in the middle of the process for the one pixel in a case where the write information used for identifying that the one pixel is a target for applying a driving voltage is stored in the first storage area referred to.

7. The display device according to claim 5, further comprising an additional write information calculating unit that, in a case where the pixel data of the display image that is stored in the second storage area and the pixel data of the provisional image that is stored in the third storage area are different from each other, calculates pixel data of an additional writing image that is a difference between the pixel data of the display image and the pixel data of the provisional image by performing a logic operation for the pixel data of the display image and the pixel data of the provisional image and stores the pixel data of the additional writing image in a fourth storage area, wherein the writing control unit updates the write information that is stored in the first storage areas based on the pixel data of the additional writing image that is stored in the fourth storage area.

8. The display device according to claim 5, wherein the write information that is stored in the first storage areas includes:

first write information that indicates writing for changing the display state of the one pixel from a state representing a first color to a state representing a second color; and second write information that indicates writing for changing the display state of the one pixel from the state representing the second color to the state representing the first color.

9. The display device according to claim 5, wherein the display unit includes a display element of a memory type.

10. The display device according to claim 9, wherein the display element is an electrophoretic element.

11. A method of controlling a display device in which a display unit including a plurality of scanning lines, a plurality of data lines, and a plurality of pixels are included, and writing for changing a display state of each of the pixels from a first display state to a second display state is performed by an operation of applying a driving voltage to the each of the pixels a plurality of times, the method comprising:

determining whether or not a new writing instruction is generated for one pixel out of the plurality of the pixels;

determining whether or not a writing operation is in the middle of the process for the one pixel in a case where the new writing instruction is determined to be generated; and performing writing control of storing write information used for identifying that the one pixel is a target for applying a driving voltage in each of first storage areas, wherein the number of first storage areas corresponds to number of frames that a driving voltage is continually supplied to change the display state of the pixel from the first display state to the second display state, sequentially referring to the first storage areas, and applying the driving voltage to the one pixel a plurality of times based on the write information that is stored in the first storage areas in a case where the writing operation for the one pixel is determined not to be in the middle of the process in the determining of whether or not the writing operation is in the middle of the process, and continuing to perform the writing operation that is in the middle of the process and performing the writing control after the writing operation is completed in a case where the writing operation is determined to be in the middle of the process for the one pixel in the determining of whether or not the writing operation is in the middle of the process;

a display image data updating unit that stores pixel data of a display image displayed on the display unit in a second storage area based on display image data that is input; and a provisional image data updating unit that stores pixel data of a provisional image to be displayed on the display unit by the writing operation that is in the middle of the process in a third storage area, wherein the provisional image data updating unit updates pixel data of the one pixel with pixel data corresponding to the pixel data of the provisional image of a case where the driving voltage is applied based on all the write information stored in the first storage areas at a timing when writing, which is based on the new writing instruction, is started for the one pixel, and wherein the rewriting determining unit determines that the new writing instruction is generated for the one pixel in a case where the pixel data of the display image that is stored in the second storage area and the pixel data of the provisional image that is stored in the third storage area are different from each other.

* * * * *